US007100437B2

(12) United States Patent
Johnson et al.

(10) Patent No.: US 7,100,437 B2
(45) Date of Patent: Sep. 5, 2006

(54) DEVICE FOR COLLECTING STATISTICAL DATA FOR MAINTENANCE OF SMALL-ARMS

(75) Inventors: Eric Arthur Johnson, Greene, NY (US); Joseph Duane Kulesza, Binghamton, NY (US)

(73) Assignee: Advanced Design Consulting USA, Inc., Lansing, NY (US)

( * ) Notice: Subject to any disclaimer, the term of this patent is extended or adjusted under 35 U.S.C. 154(b) by 0 days.

(21) Appl. No.: 10/720,778

(22) Filed: Nov. 24, 2003

(65) Prior Publication Data

US 2005/0155420 A1 Jul. 21, 2005

(51) Int. Cl.
*G01L 5/14* (2006.01)

(52) U.S. Cl. ..... 73/167

(58) Field of Classification Search ..... 73/167; 42/1.01–1.05; 124/71

See application file for complete search history.

(56) References Cited

U.S. PATENT DOCUMENTS

| | | | | | |
|---|---|---|---|---|---|
| 2,306,747 | A | * | 12/1942 | Edmond | 42/1.03 |
| 2,984,104 | A | * | 5/1961 | Levine | 73/167 |
| 3,127,768 | A | * | 4/1964 | Mason | 73/167 |
| 3,453,882 | A | * | 7/1969 | Deas et al. | 73/167 |
| 3,792,638 | A | * | 2/1974 | Cox et al. | 89/14.05 |
| 3,902,368 | A | * | 9/1975 | Hasenbein et al. | 73/167 |
| 3,914,996 | A | * | 10/1975 | Davis et al. | 73/167 |
| 4,001,961 | A | | 1/1977 | Johnson et al. | |
| 4,146,987 | A | | 4/1979 | Hudson et al. | |
| 4,379,405 | A | * | 4/1983 | Engeler et al. | 73/167 |
| 4,486,710 | A | * | 12/1984 | Schmidt | 324/179 |
| 4,541,191 | A | * | 9/1985 | Morris et al. | 42/1.01 |
| 4,928,523 | A | * | 5/1990 | Muhrer et al. | 73/167 |
| 5,005,307 | A | | 4/1991 | Horne et al. | |
| 5,303,495 | A | | 4/1994 | Harthcock | |
| 5,402,678 | A | * | 4/1995 | Fritz et al. | 73/167 |
| 5,406,730 | A | | 4/1995 | Sayre | |
| 5,566,486 | A | * | 10/1996 | Brinkley | 42/1.02 |
| 5,642,581 | A | | 7/1997 | Herold et al. | |
| 5,659,148 | A | * | 8/1997 | Isgen | 89/14.05 |
| 5,918,304 | A | | 6/1999 | Gartz | |
| 6,094,850 | A | | 8/2000 | Villani | |
| 6,311,682 | B1 | * | 11/2001 | Rice et al. | 124/71 |
| 6,590,386 | B1 | * | 7/2003 | Williams | 324/178 |
| 6,615,814 | B1 | * | 9/2003 | Rice et al. | 124/71 |
| 6,643,968 | B1 | * | 11/2003 | Glock | 42/1.02 |
| 2003/0167909 | A1 | * | 9/2003 | Matter | 89/14.1 |

FOREIGN PATENT DOCUMENTS

| | | | | |
|---|---|---|---|---|
| DE | 3911804 | A1 | * | 7/1990 |
| DE | 4022038 | A1 | * | 1/1992 |
| DE | 4417545 | A1 | * | 11/1995 |
| EP | 283524 | A | * | 9/1988 |
| JP | 10089894 | A | * | 4/1998 |
| JP | 11051785 | A | * | 2/1999 |

* cited by examiner

*Primary Examiner*—Hezron Williams
*Assistant Examiner*—John Fitzgerald
(74) *Attorney, Agent, or Firm*—Brown & Michaels, PC

(57) ABSTRACT

A device for collecting data on small-arms usage that senses when a shot has been fired from a gun using its acceleration, acoustic noise or RF emissions; measures the interval between shots so that the firing rate may be determined; measures the time at which each shot has been fired; measures the temperature of the barrel when each shot is fired; stores any combination of temperature, firing rate, firing intervals and time data for subsequent analysis and has an electrical interface to transfer data from the device to a computer or other data collection device.

51 Claims, 12 Drawing Sheets

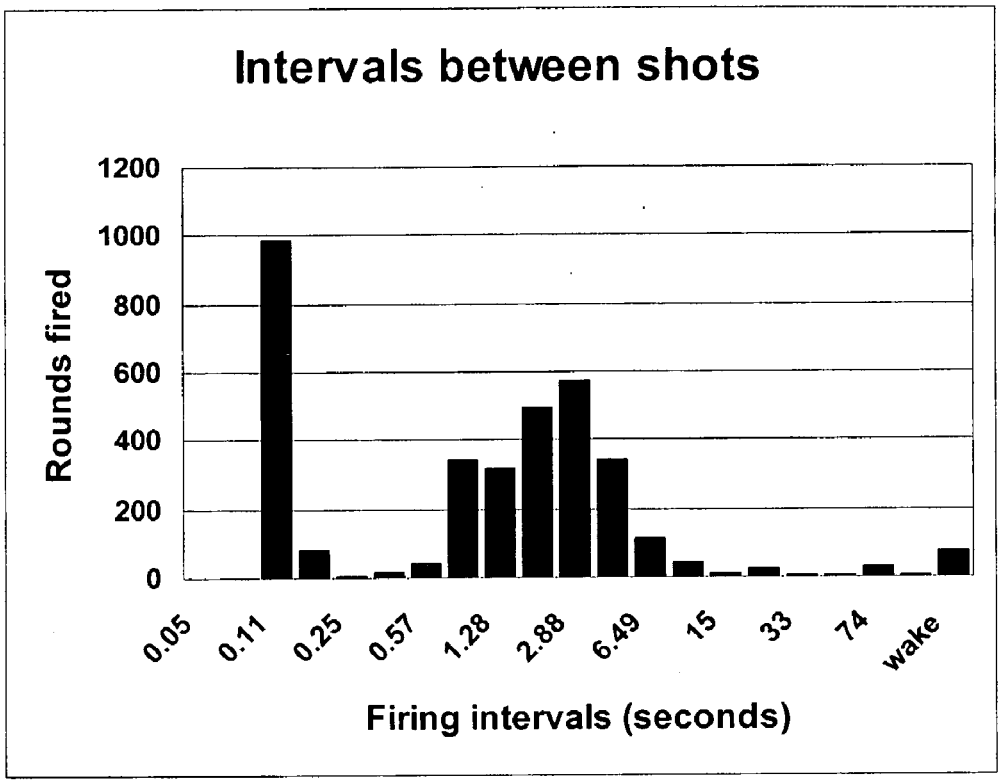
FIGURE 8A (ABOVE) AND 8B (BELOW)
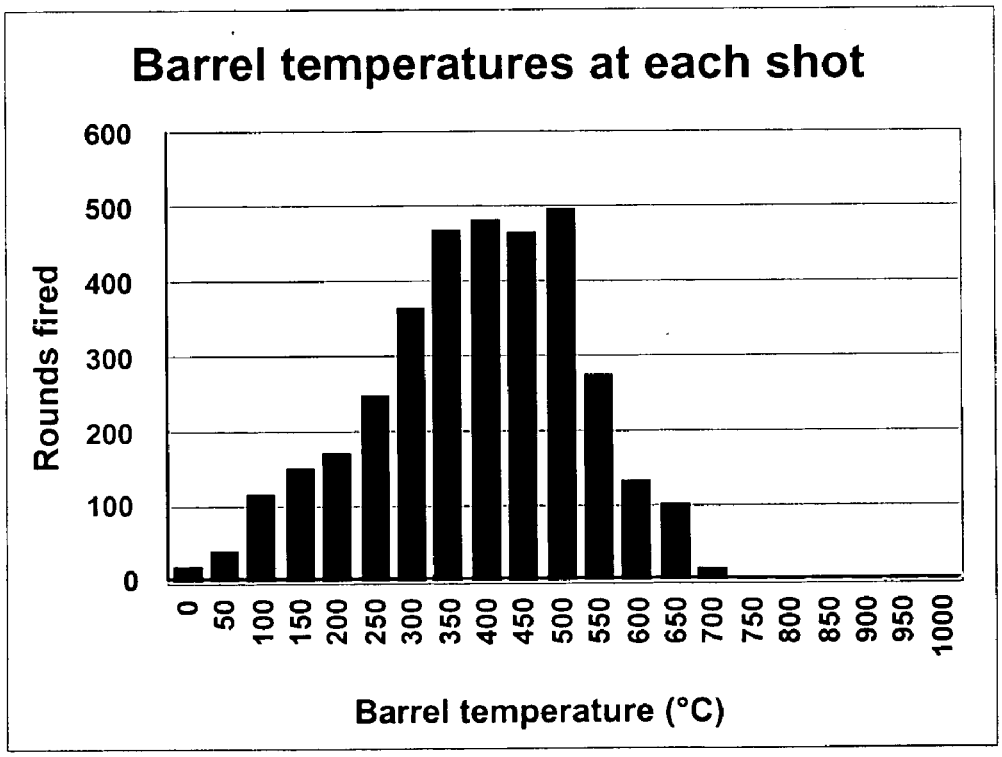

DEVICE FOR COLLECTING STATISTICAL DATA FOR MAINTENANCE OF SMALL-ARMS

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of usage monitors for small-arms and more specifically to a device for determining wear in small-arms through data collection and statistical analysis.

Many devices have been proposed to monitor the number of rounds fired an automatic or semi-automatic weapon. In general these devices are meant to warn the shooter before the magazine becomes empty. Some of these devices count the number of rounds in a magazine; others assume that a full magazine has been inserted and count the number of rounds fired using a shot detector. A few devices have been proposed that record the time and date when a weapon was fired, particularly for use in criminal investigations. Yet other devices are currently in use on paint-ball guns for scoring, timekeeping and billing purposes. Although all of these devices are able to impart useful information about small-arms use over short periods none can provide information that can be related to wear of the barrel or internal mechanisms that are an essential part of any maintenance program.

Maintenance of small-arms is of particular concern to law enforcement, the military and to competitive shooters. Wear gradually degrades the accuracy of a firearm and in extreme cases can lead to the bursting of a barrel and injury to the shooter. Wear can also lead to jamming, particularly in automatic and semi-automatic firearms. Maintenance schedules based on time in service completely ignore the firing schedule of a firearm. When used in training thousands of rounds can be fired in a period of several months while in other periods a firearm may remain completely unused. A monitor that can be used to relate the firing history to barrel wear would allow maintenance to be based on usage, thereby benefiting all users of small-arms.

Some attempts have been made to record such data. In patents by Davis et al, (1975, U.S. Pat. No. 3,914,996) and by Gartz (1999, U.S. Pat. No. 5,918,304) an electronic apparatus is disclosed for determining the wear of the gun tube of an artillery weapon. Wear in an artillery gun barrel is governed not only by the number of rounds fired but also by the charge, which may be varied with each round. Davis et al used a strain transducer to detect that a shot had been fired and applied a weighting function, proportional to the strain level, to determine the charge. The weighted number of shots fired was then stored in memory so that barrel wear could be estimated.

The approach of Davis et al fails to take into account the effects of temperature on barrel wear. If a series of rounds are fired the gun barrel is heated and wear, which results from the abrasive properties of the propellant, corrosion by the expanding gases and thermal gradients through the barrel wall, is greatly accelerated. It is also of limited applicability to small-arms where the shock and vibration of ordinary handling could produce many false counts.

In U.S. Pat. No. 4,001,961 (Johnson et al, 1977) a shot counter is attached to a firearm for use in a maintenance program. As an example, they cite the replacement of the extractor after 15,000 rounds have been fired. Firing is detected by a micro-switch on the trigger, an inductance or piezoelectric transducer in the buffer, or an inertial switch that responds to recoil. The switches complete an electric circuit containing a battery that allows an electrochemical plating process to proceed while the transducers are used in a passive system, providing the electric potential that drives the plating. Usage is monitored by comparing the thickness of the plated layer at one end of a transparent tube to a color-coded scale on or adjacent to the tube. As in the previous citation there has been no thought given to avoiding false counts through handling.

Avoiding false counts is addressed in a patent by Hudson et al (1979, U.S. Pat. No. 4,146,987). An inertial switch comprising a pivoting, eccentric mass, a mechanical counter and a spring that allows a threshold acceleration to be set. This purely mechanical system is relatively large and difficult to implement on small-arms. It is also likely to undergo a change in threshold as the contact surface between the spring and the shaft wear during use. Clearly an electronic device is preferable for use with small-arms where size and weight are important concerns.

An example of an electronic shot counter for small-arms is that patented by Horne and Wolf (1991, U.S. Pat. No. 5,005,307). Two micro-switches are used to provide input to a micro-controller that counts the rounds remaining in a magazine. An LCD display is used to indicate this count. Insertion of a new magazine is sensed by the first switch and the count is reset. Firing is detected by a second switch on the gun's slide. Doubtless this device could be modified to count the cumulative number of shots fired, however, slide movement while unloaded or when chambering the first round from a new magazine will result in false counts.

A number of other patents add desirable features to the teaching of Horne and Wolf. The aforementioned device cannot differentiate whether a round is in the chamber when a new magazine is inserted; Herold et al (1997, U.S. Pat. No. 5,642,581) resolve this ambiguity by allowing the user to increment the count indicated by the counting device; Villani (2000, U.S. Pat. No. 6,094,850) teaches the use of an additional switch within the chamber to automatically adjust the count. Neither device can differentiate between a round that has been fired and one that has been ejected without firing as required when a weapon is to be made safe.

Other inventors have sought to eliminate micro-switches in order to reduce cost and complexity while improving accuracy, reliability and sensor life. U.S. Pat. No. 5,406,730 (1995, Sayre) describes the use of an inertial switch in combination with an acoustic sensor to detect firing. Handling shocks cannot cause false counts because an acoustic signal must occur simultaneously before the count is incremented. Similarly, an acoustic signal from a weapon fired nearby cannot increment the count unless a simultaneous recoil is detected. Brinkley, in U.S. Pat. No. 5,566,486 (1996), discloses an inertial switch that is adjustable; this makes it possible to set the acceleration level that will trigger a count so that recoil can be differentiated from handling shock. An additional benefit of this device is it ability to be adjusted to work on weapons with different recoil characteristics. A stated use of Brinkley's shot counter is to record the number of shots fired during a firearm's lifetime for use in its maintenance.

The patent of Harthcock (1994, U.S. Pat. No. 5,303,495) teaches the use of a Hall-effect device for counting shots fired from small-arms. A micro-processor records in non-volatile memory the time and date of each shot fired along with the direction, from a Hall-effect compass, for crime lab analysis. In common with many of the previously described devices this counter cannot distinguish between the firing of a round, the chambering of the first round after the last shot in a magazine has been fired or the ejection of an unfired round.

The most technologically advanced devices for monitoring the firing of a projectile have been developed for use in paintball guns. When used in commercial applications it is important to record the number of rounds fired and the amount of time that a gun has been used. It is also desirable to provide information such as firing rate, maximum firing rate and battery condition to the user and to communicate these data, along with the gun's identification number, back to a control center. These features are all taught in U.S. Pat. No. 6,590,386 (2003, Williams) and U.S. Pat. No. 6,615,814 (2003, Rice and Marks). Both patents teach the use of a temperature sensor that is used to monitor the pneumatic canister that powers the projectiles. Williams differs from Rice et al in the use of a detachable device that fits onto the muzzle end of the barrel and additionally measures projectile velocity.

Since barrel temperature is known to be a critical factor in determining the rate of wear it must be monitored during firing if an accurate assessment of a weapon's condition is to be made. None of the patents cited have means to measure this temperature nor do they have a way to determine the number of rounds fired at a particular temperature. None address data storage and its presentation so that it can be easily interpreted by the user or by an armorer. Further shortcomings of the aforementioned devices is their inability to be easily adapted for use on different weapons. With the exception of Williams's device all are difficult to retrofit to a variety of small-arms. Furthermore, those devices that utilize inertial switches, thereby avoiding the miscounts that are inherent in other sensing systems, cannot easily be altered to accommodate accessories such as night-vision scopes or noise suppressors that substantially change the mass of a weapon.

BRIEF SUMMARY OF THE INVENTION

It is, therefore, the primary object of this invention to monitor the firing of small-arms so that service actions may be taken to maintain the weapon in serviceable condition.

Another object of the invention is to record information regarding the number of shots fired, the firing interval between shots and the temperature of the barrel as each shot was fired so that wear can be accurately assessed.

Still another object of the invention is to monitor the firing rate so that the weapon may be serviced before an excessive rate, that could lead to jamming, occurs.

A further object of the invention is to record and present firing data statistically so that it may be easily interpreted by the user or an armorer.

A yet further object of the invention is to record firing rate data that can be used to monitor and certify a user's training.

Yet another object of the invention is to record times and dates that a weapon has been fired for use in criminal investigations.

Still yet another object of the invention is to package the electronics of this data collection system so that it can withstand temperatures of up to at least 1100° F. on the barrel's surface.

An additional object of the invention is to provide a complete Faraday cage surrounding the electronics so that radio frequency emissions are minimized.

A further object of the invention is to provide a simple, easy-to-use, man-machine interface for data collection in the field.

Other objects and advantages of the present invention will become apparent from the following descriptions, taken in conjunction with the accompanying drawings, wherein, by way of illustration and example, an embodiment of the present invention is disclosed.

In accordance with a preferred embodiment of the invention there is disclosed a device for collecting data on small-arms usage comprising: A means to mount the electronics onto or within a gun so that it is protected from the heat of the barrel; a means to sense that a shot has been fired from a gun using acceleration, acoustic noise, magnetic field or RF emissions; a means to measure the interval between shots so that the firing rate may be determined; a means to measure the time at which each shot has been fired; a means to measure the temperature of the barrel when each shot is fired; means to store any combination of temperature, firing rate, firing intervals and time data for subsequent analysis, and a means to transfer data from the device to a computer or other data collection device.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention. Like numbers are used to represent like parts of the invention throughout the drawings.

FIGS. 8*a* and 8*b* are sample histograms of data collected by the invention.

DETAILED DESCRIPTION OF THE INVENTION

Figure 1:
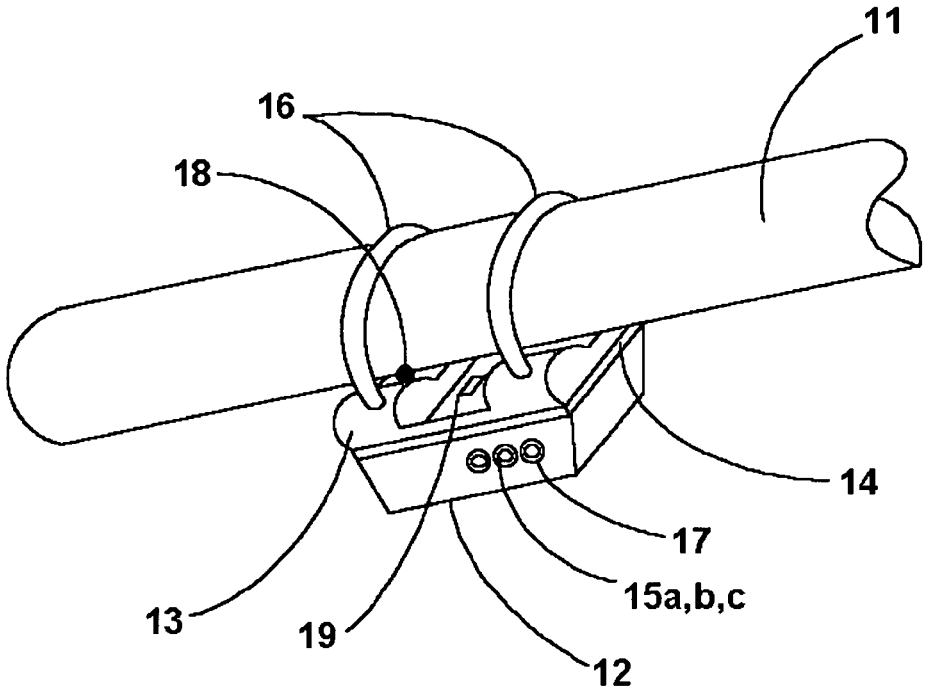
FIG. 1 is an isometric view of the invention mounted directly on a gun barrel.
Figure 2:
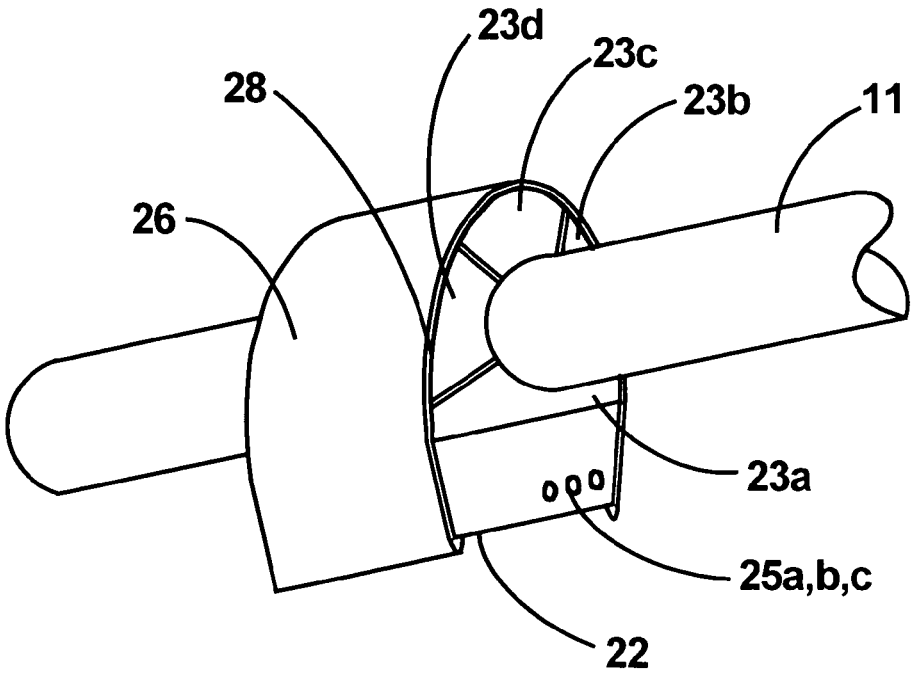
FIG. 2 is an isometric view of the invention mounted directly on a gun barrel using an alternate attachment scheme.

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Before describing the function and uses of the shot counter its mounting to a weapon will be described. Since an object of the invention is to measure the barrel temperature during firing the shot counter must be in thermal communication with the barrel. During heavy firing of an automatic weapon the gun barrel can reach temperatures of 400° C. or higher. Most commercial electronics are designed to operate at temperatures no higher than 125° C. and eutectic tin-lead solders melt at 183° C. Consequently, the shot counter must be thermally isolated from the barrel. This may be accomplished by separating the device from the barrel and using a remote temperature sensor or by insulating the device from the barrel and providing sufficient surface area for free convection cooling to be effective.

One of many possible mounting schemes is shown in figure one. In this embodiment the shot counter's case 12 is attached to the barrel 11 by clips 16 via insulators 13 and adhesive layer 14. The clips 16 may be threaded into nipples (not shown) that are retained within insulator 13 or they may be designed to simply clip into place; these and other mounting schemes are widely practiced. It is advantageous to use a material such as stainless steel for clips 16 since this may be easily formed, has a high yield strength and a low thermal conductivity, however, many other materials may be used.

Insulator 13 may be made from any material that has sufficient strength and a low thermal conductivity. Ceramic materials meet these requirements, particularly glass ceramics which have a conductivity of less than 1 W/m° C. Stainless steel may also be used if its higher conductivity, typically 10 to 20 W/m° C., is countered by the addition of cooling fins on the insulator.

Case 12 may be attached to insulator 13 by any means that does not form an efficient thermal conduction path. A high-temperature silicone adhesive 14 is preferred as this class of material can withstand temperatures of over 400° C., has excellent adhesion to most materials and is resistant to attack by most common solvents. Useful alternate adhesives include cyano-acrylates and high-temperature epoxies. Mechanical fasteners with low thermal conductivity, for example ceramic or stainless steel machine screws, can also be used.

A thermocouple can be used as the temperature sensor. This may be embedded within the contact surface of insulator 13 with the bead 18 positioned so that it will contact the barrel 11. Alternatively a spring or compliant material can be used to maintain the thermocouple bead in contact with the barrel. If an infrared device 19 is used it is sufficient to provide a path for thermal radiation to reach the detector.

The shot counter case 12 is provided with a plurality of contacts 15*a–c* for communication to an external device such as a laptop or hand-held computer. These contacts must be electrically isolated from case 12 by an insulating material 17. It is important to minimize the size of the electrical connection in order to prevent the escape of electro-magnetic radiation and to minimize radio-frequency interference. This is of great concern in military applications where an enemy combatant could use RF emissions to target a shooter. A display, such as an LCD, is a common source of RF emissions—for this reason a display is an optional part of the shot counter depending on its intended use.

A second mounting scheme for the shot counter is shown in figure two. In this embodiment a segmented insulating material 23*a–d* is clamped around the barrel 11 by a strap 26. This clamp may be tightened by any well-known means such as an eccentric lever, cam, thermal expansion, stretching, etc. It may also mechanically retain case 22 against insulator segment 23*a* although mechanical fasteners and adhesives can equally well be used. The insulating segments 23*a–d* accommodate small variations in the diameter of the barrel 11 and simplify installation.

Insulating material 23*a–d* must be able to withstand contact with barrel 11 as temperatures rise to 400° C. and above. There is, however, a significant thermal gradient radially outwards from the barrel 11 through the insulators 23*a–d* to the strap 26. Another insulating layer, 28, that has lower conductivity than material 23*a–d* but is less able to survive the high temperatures adjacent to barrel 11, may optionally be used to further reduce heat-transfer to the strap 26. Similarly, a layer of low conductivity material 29 may be disposed between insulator 23*a* and case 22. Materials that may be used for layers 28 and 29 include silicones and Muscovite mica. Insulation of any insulating layer may be further improved by surface roughening, the creation of air pockets, sintering with minimal densification and other processes known to those versed in the art.

The temperature sensor (not visible) projects from the case 22 through insulators 29 and 23*a* to barrel 11. If a thermocouple is used as a sensor a spring or compliant material can be used to maintain it in contact with the barrel. If an infrared device is used it is sufficient to provide an opening for thermal radiation to reach the detector.

As in the first embodiment contacts 25*a–c* are provided for communication. A display may optionally be provided.

Figure 3:
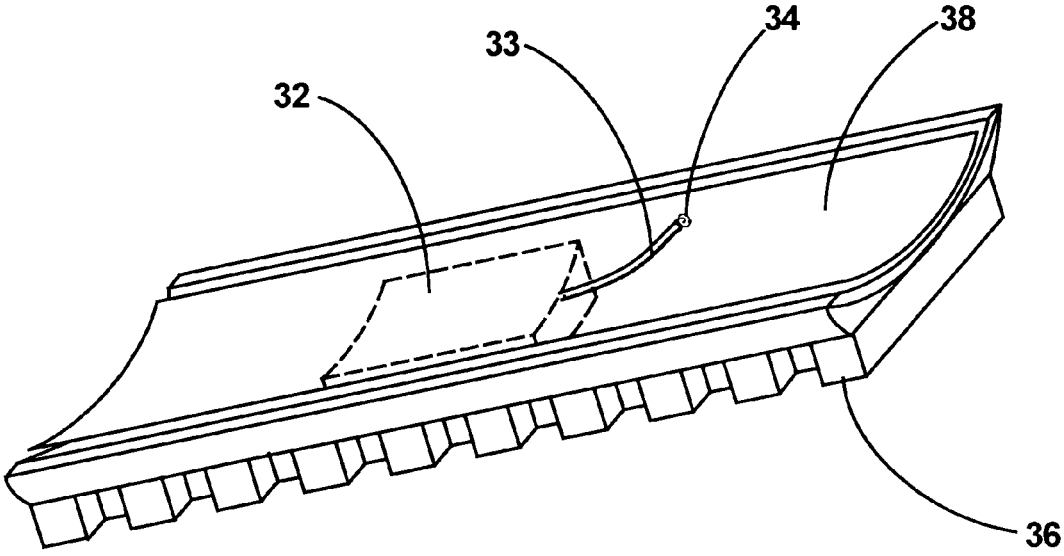
FIG. 3 is an isometric view of the invention mounted on a rail interface system.

The shot counter may be incorporated within a weapon or adapted to be mounted on an attachment rail as illustrated in FIG. 3. The electronics of the shot counter are enclosed within the case 32 that is attached to mounting rail 36, underneath the heat shield 38, in any of several widely used manners. A contact (not visible) within the mounting rail 36 connects temperature sensor 34 to the electronics within case 32. If the temperature sensor 34 is a thermocouple a spring 33 is used to hold it against the barrel (not shown). Contacts and a display may be provided.

Many other mounting methods may be envisaged for the shot counter. It may be embedded within a hand grip or stock, clipped or strapped onto the weapon or inserted within the space between the barrel heat-shield and the hand-grip or rail interface system.

The operation of the shot counter will next be explained with reference to the block diagram of figure four. Power is supplied by one or more batteries 42. Since it is desirable to minimize the size and weight of the shot counter while maximizing the intervals between battery replacement zinc-air batteries are preferred. These have the highest charge density that is currently available.

Since power consumption is of critical importance a low-power microprocessor 40 that has a sleep mode has been used. In this embodiment at least three A/D inputs and at least two timers are required although these requirements can be reduced if different sensors and timing schemes are employed. It is also advantageous to have on-board non-volatile memory for data storage. An example of a processor that meets these requirements is the PIC18LF2320 by MicroChip Inc. This is a RISC processor with 256 bytes of onboard EEPROM and 8192 bytes of program memory. In sleep mode its power consumption can be as low as 0.2 μA while in operation it is less than 600 μA when operating at a clock speed of 4 MHz. This clock speed represents a good compromise between processing speed and power consumption within this device.

Three inputs are provided to the microprocessor 40 that make it possible to sense that a shot has been fired and to measure the temperature of the barrel. In one embodiment a piezo-electric accelerometer 43 is used to detect firing. This accelerometer is most effectively mounted with its base attached to the case of the shot counter (not shown) and oriented along the axis of the barrel so that the recoil of the gun, which occurs whenever a shot has been fired, produces a measurable charge. This charge may be measured as a voltage at one of the A/D inputs 41*a* of the microprocessor 40. An accelerometer is especially useful in this application since it consumes no power. In addition, it can be tuned to provide peak response in the frequency range of interest.

Referring now to figure five the details of the accelerometer mounting will be described. An accelerometer typically consists of a piezo-electric ceramic slab 51 that is loaded by a mass 52 and mounted within a case 53. Tuning may be accomplished by mounting the accelerometer 56 on a thick layer of a soft material such as silicone rubber 54. The relationship between the stiffness of the mounting layer 54 and the mass of the accelerometer 56 determines the system's frequency response.

Figure 6:
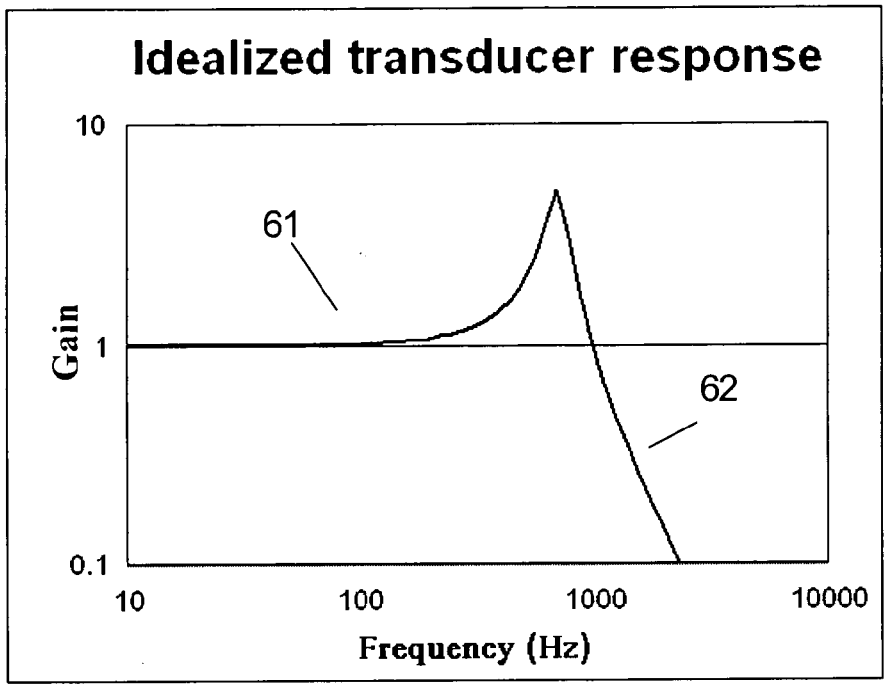
FIG. 6 is a graph of an idealized accelerometer's frequency response.
Figure 5:
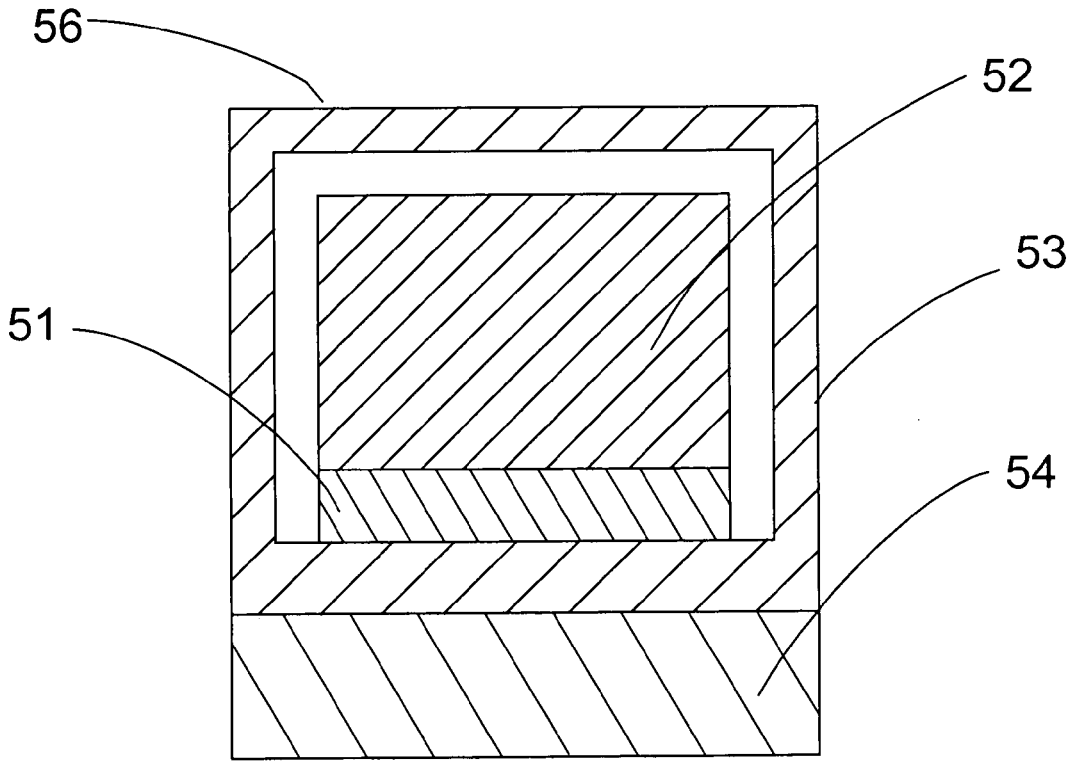
FIG. 5 is a cross-sectional view of an accelerometer with a mechanical filter that may be used as a sensor.

From FIG. 6 it may be seen that signals at frequencies well below resonance 61 are unamplified while those well above the accelerometer's resonance frequency 62 are attenuated—the compliant mounting acts as a mechanical low-pass filter. Impacts on the barrel or the action of an automatic or semiautomatic weapon excite resonances within the barrel that could lead to a false indication that a shot has been fired if an accelerometer is used as a sensor. By setting the resonance frequency of the accelerometer to be below the lowest resonance frequency of the barrel most false counts can be eliminated. For weapons such as an M4 carbine or an M16 this frequency should be below 3 kHz and more preferably below 1 kHz. For other weapons the barrel's resonance should be measured to determine the appropriate cut-off frequency. Mechanical filtering, as characterized by response curve in FIG. 6, requires no power. While the same response could be achieved using an electrical low-pass filter or resonant circuit this would require the addition of a charge amplifier, increasing the power consumption and limiting the battery life.

The remaining inputs to the shot counter will now be described with reference to figure four. Elevated barrel temperature has been shown to increase the rate of barrel wear which leads to inaccuracy of the weapon. Thus it is important to know the temperature of the barrel as each shot is fired. Temperature may be measured with a thermocouple 45 and a thermistor 46 using well-known techniques. The thermocouple consists of two wires of different materials joined to form a measurement junction 45*a* that produces a voltage proportional to the junction temperature. Measurement junction 45*a* is held against the gun barrel when the shot counter is mounted so that its temperature may be measured. A leaf-spring (not shown) is easily adapted for this purpose.

The opposite end of the thermocouple leads are typically mounted on copper pads to form reference junctions 45*b* and 45*c*. These reference junctions 45*a* and 45*b* also produce a voltage that is proportional to their temperature and, as a result, it is necessary to know their temperature if the temperature at the measurement junction 45*a* is to be determined. This is accomplished by providing an isothermal block 44 that is electrically, but not thermally, isolated from the reference junctions 45*b*, 45*c* by a very thin electrically insulating layer. In printed circuit cards block 44 is usually a large copper feature such as a buried ground plane. In addition thermistor 46 is also electrically, but not thermally, isolated from the isothermal block 44. By using the resistance of the thermistor 46 the temperature of the isothermal block 44 can be determined and the voltage produced at the reference junctions 45*b* and 45*c* can be compensated for.

Compensation can be accomplished with the addition of discrete components within the device or, preferably, using logic within the microprocessor 40. Discrete devices are not favored because they consume power unnecessarily. The voltage produced by the thermocouple 44 is conditioned using an op-amp 47 and input to one of the A/D converters 41*b* of the microprocessor 40. The voltage from the thermistor 46 is conditioned by a second op-amp 48 and input to a second A/D converter 41*c*. Look-up tables within the microprocessor are then used to compensate for the reference junction temperature and accurately determine the temperature at the measurement junction 45*a*.

Power consumption by the op-amps 47 and 48 is limited by making use of a remote enable line 49 to turn them on and off. It has been found that a period of less than 10 milliseconds is sufficient to make temperature measurements. When a shot has been detected the microprocessor output 41*d* drives the enable line 49 high so that the temperature can be read. After a period of less than 10 milli-seconds the enable line 49 is driven low and no further power is consumed by the op-amps 47 and 48.

The data collection and storage scheme will now be described with reference to FIG. 8. While it is possible to store all data sequentially it is preferable to store data in the form of histograms. Much less memory is required for data in this form making it possible to use on-chip EEPROM or other non-volatile memory and thereby reducing the size, power consumption, complexity and cost of the shot counter.

FIGS. 8*a* and 8*b* show two histograms that each have 20 intervals or bins. The choice of the number of bins that are used is arbitrary and limited only by the available on-chip memory. Whenever a shot has been fired the interval from the previous shot is calculated, compared to the limits of the interval histogram in FIG. 8*a*, and the appropriate bin is incremented within memory. If the shot-counter has been awakened from sleep mode, the shot interval is indeterminate and the wake bin is incremented. In addition to incrementing the shot count and the interval histogram the barrel temperature is calculated and the appropriate bin within the temperature histogram in FIG. 8*b* is incremented. In this embodiment each memory location uses a 16-bit word for the count giving a maximum of >65 thousand shots per bin. In order to make the shot counter adaptable to a wide range of small arms the limits on the bins are user programmable and stored within on-chip EEPROM or other non-volatile memory along with the collected data and all input parameters.

Figure 7:
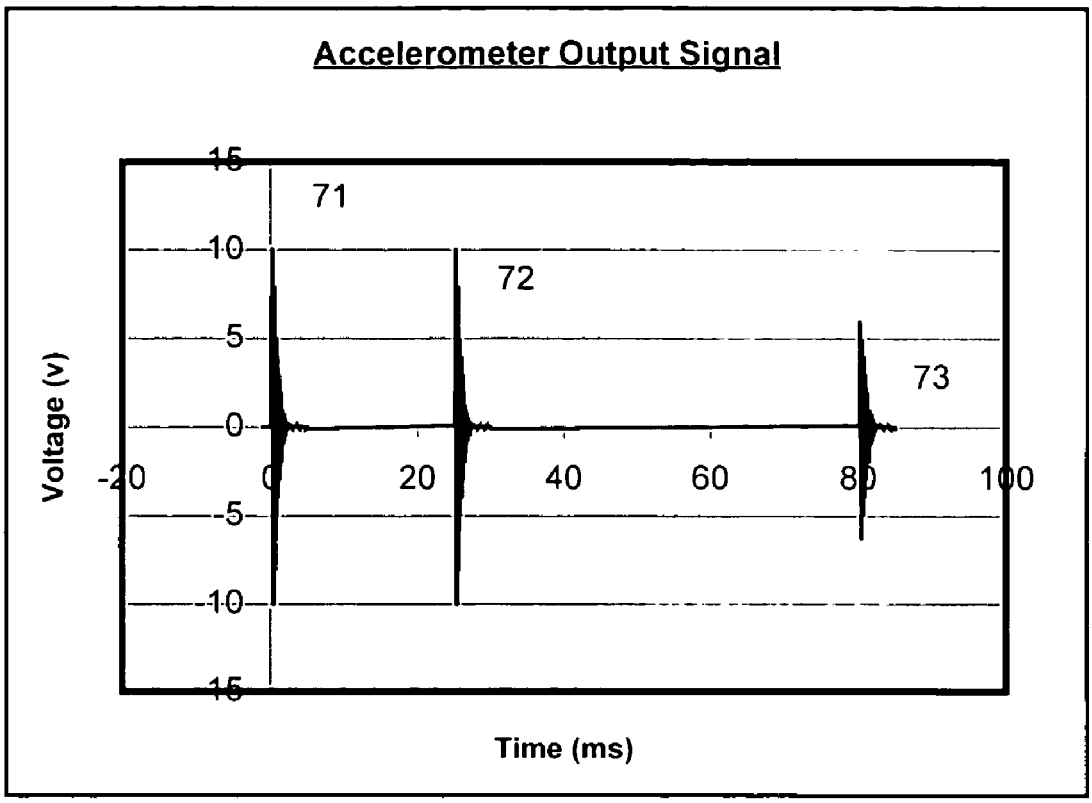
FIG. 7 is a plot of the signal output by a sensor used for input to the invention.

FIG. 7 shows a typical accelerometer signal response to a single shot fired by a typical automatic or semi-automatic weapon. The first peak 71 is the result of the shot itself, the second peak 72 is generated by the bolt hitting the back of the bolt housing, and the third peak 73 is generated by the bolt forcing the next round into the chamber and rotating the lock closed. This third peak 73 may not be present in some weapon types after the final round contained within a magazine has been fired.

Figure 9:
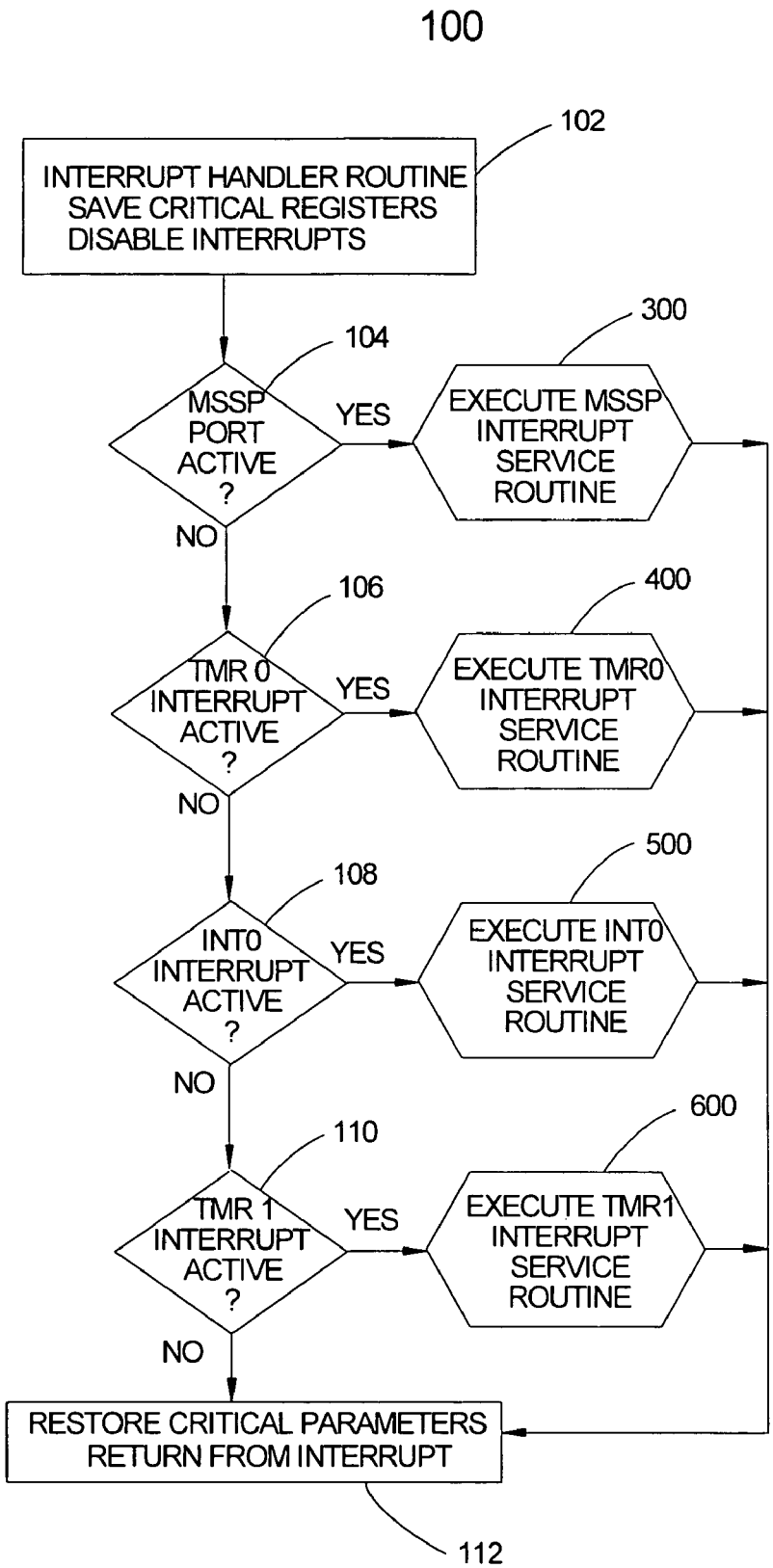
FIG. 9 is a flow-chart for the interrupt handler subroutine.

The logic used by the shot counter in response to a signal similar to that of FIG. 7 will next be described. FIG. 9 illustrates the interrupts used by the system. The microprocessor employs four interrupts sources: Master Slave Serial Port (MSSP) which is used for communication with an external device such as a PC or palmtop computer; Timer 0 (TMR0), which produces an interrupt every millisecond when active; Timer 1 (TMR1) which is used to control a programmable hold-off delay after a shot has been sensed; and Interrupt 0 (INT0) which occurs when a signal is detected that exceeds a threshold level. Only MSSP and INT0 can wake the processor from sleep mode.

INT0 is generated by the onboard comparator. This comparator uses the internal, programmable, reference voltage as one input and the signal from the piezo-electric accelerometer as the other. This allows the user to alter the threshold level so that shocks produced by normal handling are not registered as shots. It also allows the shot counter to be adjusted to work on a wide variety of small-arms.

When an interrupt is received the interrupt handler routine 100 is initiated as shown in FIG. 9. Values in critical registers are saved and further interrupts are disabled in step 102. If, in step 104, the MSSP port is found to be active a command has been detected on the communication bus and the program executes the MSSP service routine 300.

Figure 10:
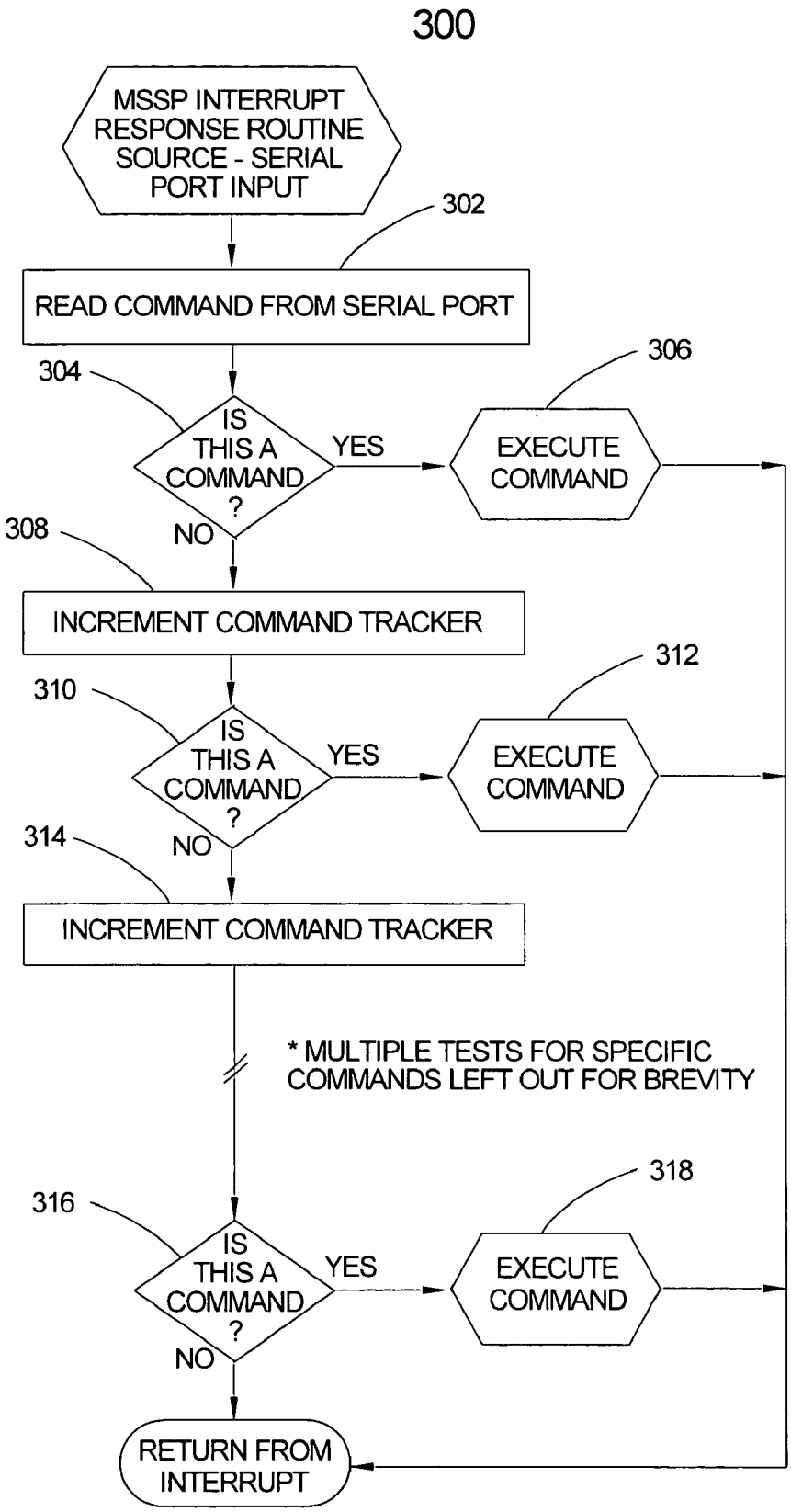
FIG. 10 is a flow-chart for the MSSP interrupt subroutine.

The sequence of operations of the MSSP service routine 300 is shown in FIG. 10. The input is read from the serial port in step 302 and compared with a first command in step 304. If true, the command is executed in step 306 and the program returns from subroutine 300. If false, the command tracker is incremented to test for a second command at 308. The input is compared to the next command in step 310 and, if true, the command is executed in step 312. The program then returns from subroutine 300. If the test is false the command tracker is incremented to test for the next command at 314. This sequence is repeated multiple times until the test for the last command is completed in step 316 and executed if true at 318. Finally, subroutine 300 returns control to the interrupt handler routine.

Further operation of the interrupt handler routine 100 will now be described with reference to FIG. 9. If the routine has executed the MSSP service routine 300 then the program branches to 112 where critical parameters are restored and control is passed to the main program. If, however, the MSSP port has not been found to be active then the TMR0 interrupt is tested at 106. If the TMR0 interrupt is active, the program executes the TMR0 interrupt service routine 400.

Figure 11:
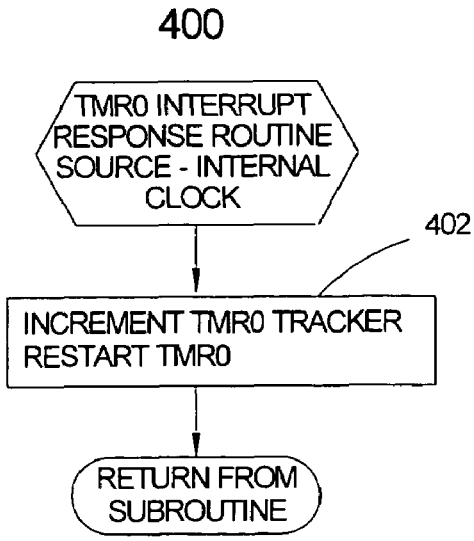
FIG. 11 is a flow-chart for the TMR0 interrupt subroutine.

The sequence of operations of the TMR0 interrupt service routine 400 is shown ill FIG. 11. As stated previously, TMR0 produces an interrupt every millisecond and is used for timing purposes. When control passes to the service routine 400 the TMR0 tracker is incremented and the timer TMR0 is restarted 402. After this event subroutine 400 returns control to the interrupt handler routine.

Referring once again to FIG. 9 the continuing operation of the interrupt handler routine 100 will be described. If the routine has executed, the TMR0 interrupt service routine 400 then critical parameters are restored and control is passed to the main program at step 112. If, however, the TMR0 interrupt has not been found to be active the INT0 interrupt is tested at 108. If the INT0 interrupt is active the program executes the INT0 interrupt service routine 500.

Figure 12:
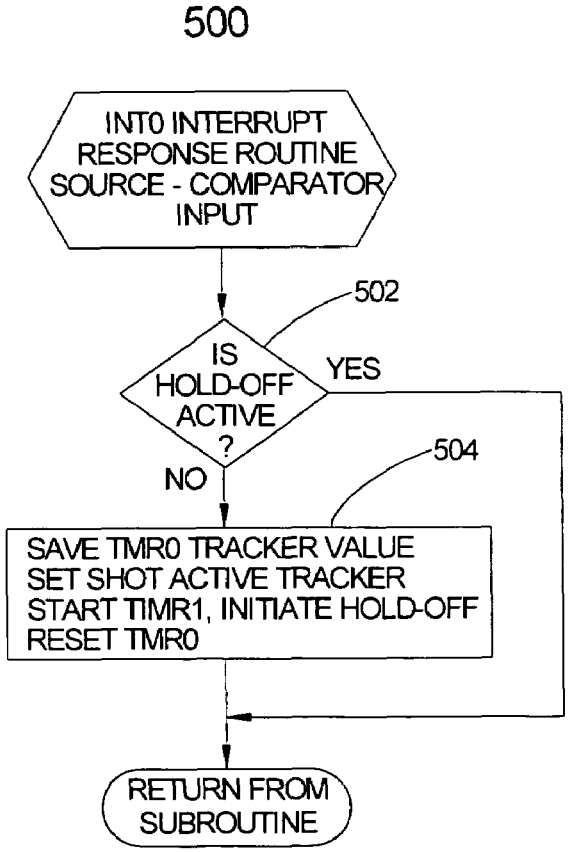
FIG. 12 is a flow-chart for the INT0 interrupt subroutine.

Referring next to FIG. 12 the INT0 interrupt service routine 500 will be described. This interrupt is generated by the comparator and indicates that an impulse has been detected which may be due to the firing of a shot. A test is performed in step 502 to determine whether the holdoff tracker is active. If true, this event should be ignored, as it is likely due to the action of the bolt, and control passes back to the interrupt service routine 100 without any action. If, however, the holdoff tracker is off, then the value of the TMR0 tracker is saved, the shot active tracker is set true and both TMR0 and TMR1 are started in step 504. TMR0 then provides an interrupt every millisecond for program timing and TMR1 initiates the holdoff period. Following these actions control reverts to the interrupt handler routine 100.

Referring yet again to FIG. 9 the continuing operation of the interrupt handler routine 100 will be described. If the routine has executed the INT0 interrupt service routine 500 then it branches to step 112 where critical parameters are restored and control is passed to the main program. If, however, the INT0 interrupt has not been found to be active the TMR1 interrupt is tested in step 110 where, if the TMR1 interrupt is found to be active, the program executes the TMR1 interrupt service routine 600.

Figure 13:
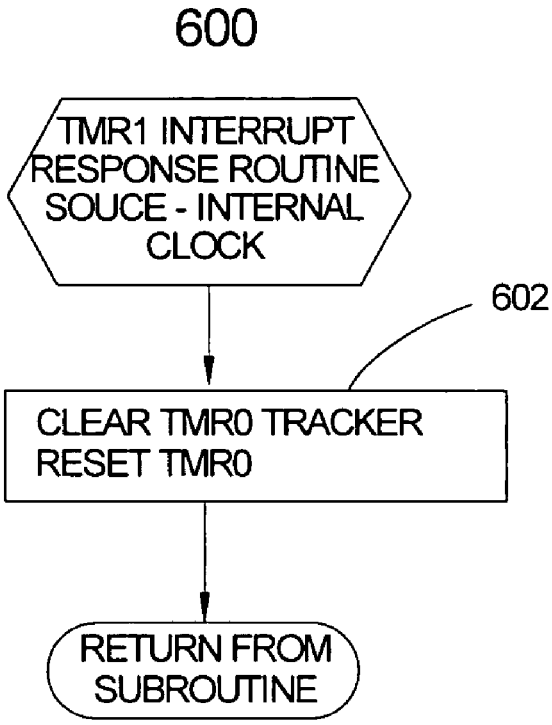
FIG. 13 is a flow-chart for the TMR1 interrupt subroutine.

Referring next to FIG. 13 the TMR1 interrupt service routine 600 will be described. TMR1 generates an interrupt when it reaches the programmable holdoff time-out. In step 602 INT0 is enabled and then TMR1 is disabled. Control then reverts to the interrupt handler routine 100.

Referring to FIG. 9 for a final time the continuing operation of the interrupt handler routine 100 will be described. Regardless of whether or not the routine has executed the TMR1 interrupt service routine 600, critical parameters are restored at 112 and control is passed to the main program.

The general operation of the shot counter will now be described with reference to FIG. 14. On power up or reset 202 the processor executes an initialization sequence 204 that reads certain values such as the hold-off and sleep delay, and comparator threshold from non-volatile memory. Other critical functions such as IO, Timer, Comparator, Interrupts, and MSSP are also established. There is no penalty or loss of data caused by a reset.

Once initialization is complete and interrupts are enabled, the processor loops through the main routine beginning at step 206. If the shot active tracker is found to be true when evaluated at 208 this indicates that there has been an INT0 interrupt and the update shot information subroutine 700 is executed.

Figure 15A:
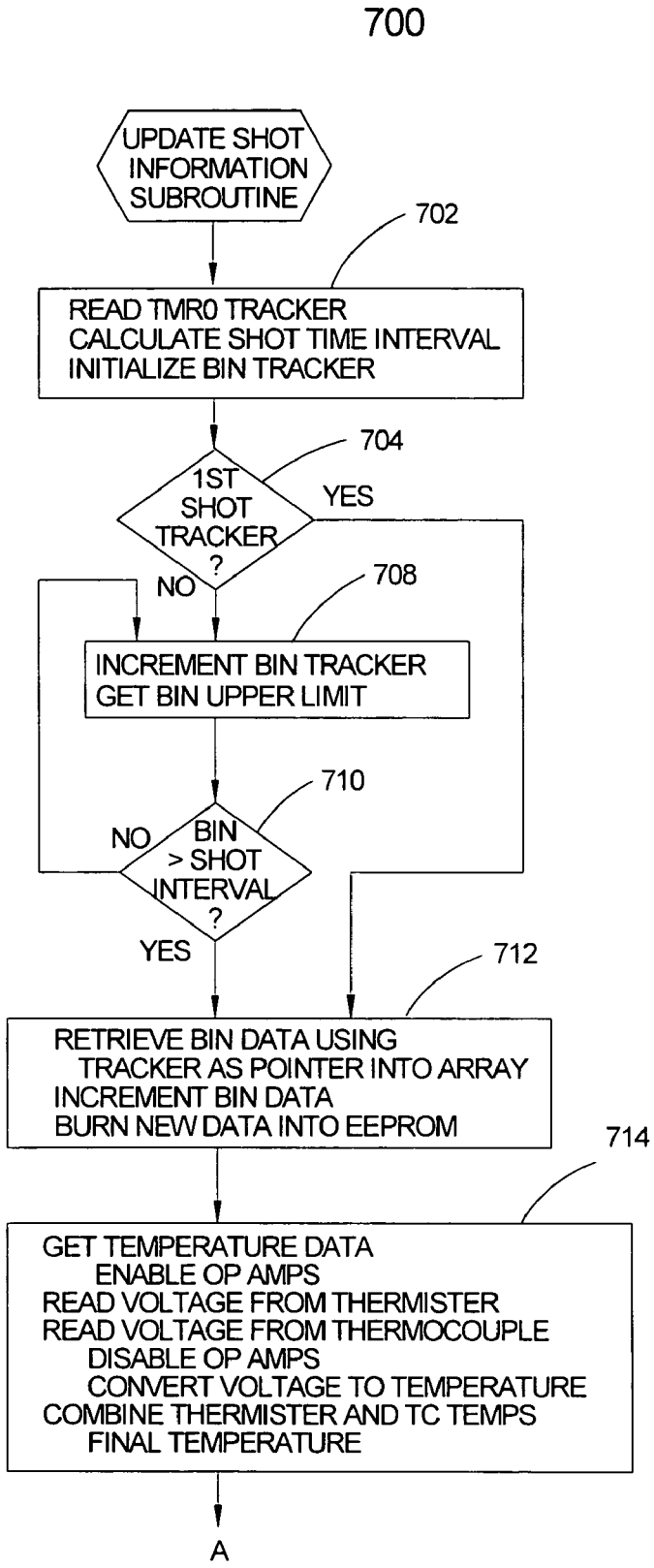
FIG. 15 is a flow-chart for the shot information subroutine.
Figure 15B:
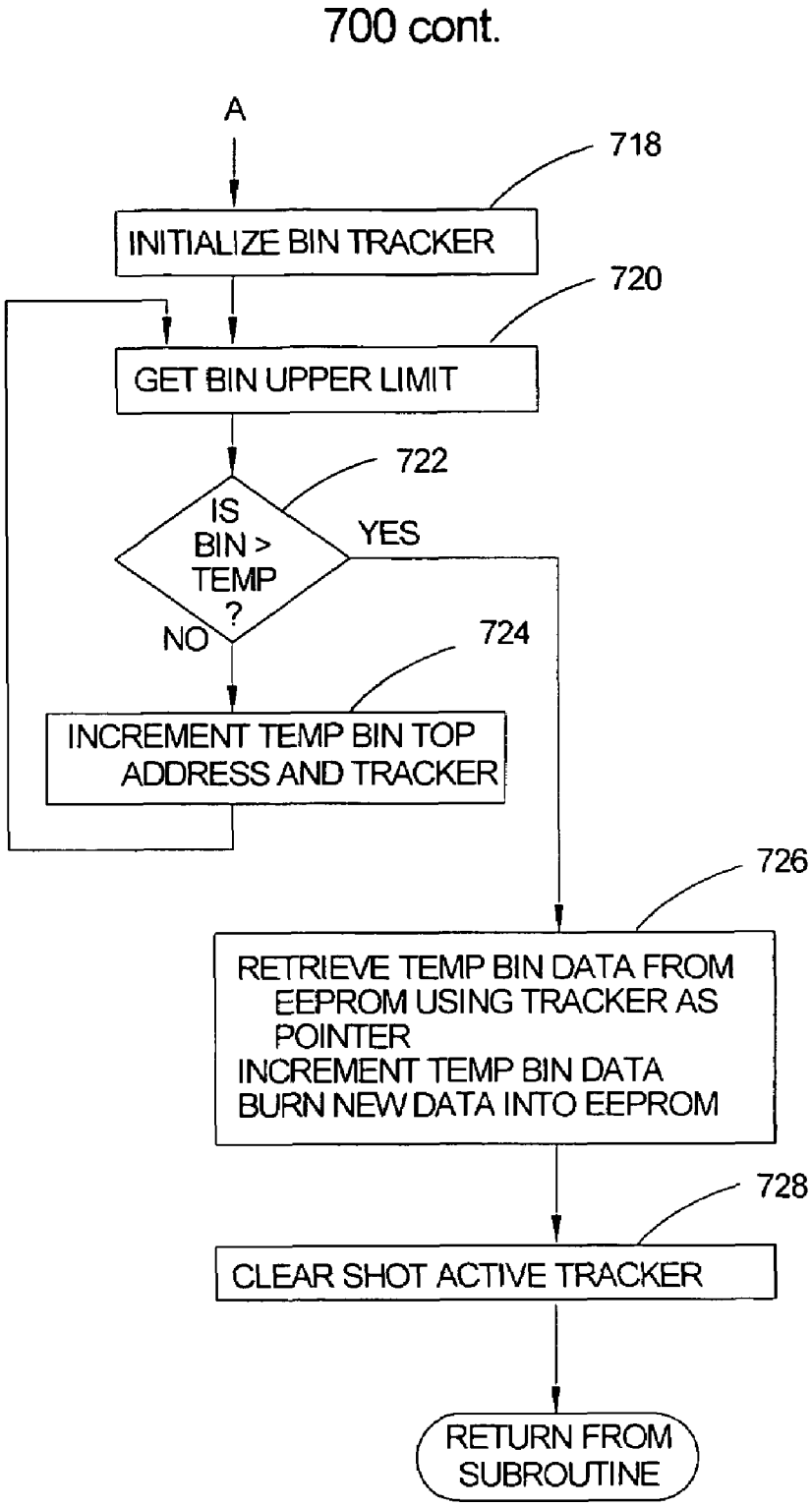

Referring next to FIG. 15 the execution of the update shot information subroutine 700 is described. In step 702 the TMR0 tracker is read to determine the number of milliseconds that have elapsed since the timer was started. This value is added to the hold off time, to determine the time that has elapsed since the last shot was detected, and assigned to the shot interval tracker. The bin tracker is then initialized. If the first-shot tracker is found to be true in step 704 the routine progresses directly to 712. Otherwise it is necessary to determine which bin in the shot interval histogram must be incremented. In this case, the bin tracker is incremented so that it points to the bin for the shortest interval and the upper limit for this bin is retrieved in 708. The value of the upper limit of this bin is compared to the elapsed time in 710. If the upper limit is less than the elapsed time the routine loops back to step 708 where it increments the bil tracker and retrieves the new upper limit. Steps 708 and 710 are repeated until the value of the upper limit for some bin is greater than the elapsed time and the routine progresses to 712.

In step 712 the bin tracker is used to retrieve the count for the appropriate shot interval, which is incremented and saved. If the bin tracker retains its initial value it is the wake-up bin that is incremented. The interval in this case is indeterminate.

Next, in step 714, the temperature of the barrel is calculated and stored. The op-amps are enabled, the voltages from the thermistor and thermocouple are read, and the op-amps are disabled. Control of power to the op-amps is necessary if battery life is to be maximized. These voltages are then converted to temperatures using look-up tables. The temperature at the reference junction, determined from the thermistor, is then used to calculate the correct temperature at the measurement junction.

Flowchart 15*a* is continued on flowchart 15*b* by matching point "A" on flowchart 15*a* to point "A" on flowchart 15*b*.

The bin tracker is then re-initialized in step 718 and the first bin's upper limit is retrieved in 720. If the bin's upper limit is less than the temperature when tested in step 722 the bin tracker is incremented in 724 and the routine loops back to step 720. Steps 720, 722 and 724 are repeated until the value of the upper limit for some bin is greater than the temperature and the routine progresses to 726. In this step the bin tracker is used to retrieve the count for the appropriate shot temperature, which is incremented and saved. Note that program flow can go from step 722 directly to step 726 the first time that the temperature is tested. Subroutine 700 returns to the main program after clearing the shot active tracker in step 728.

Referring once again to the main program 200, as shown in FIG. 10, the TMR0 tracker is next compared to the sleep variable in step 210. If the value of the TMR0 tracker is less than the programmable sleep variable then the program loops back to step 206. However, if it is greater, then there have been no recent interrupts from the comparator and step 212 is executed where the microprocessor enters its sleep mode. Just prior to sleep mode, TMR0 and TMR1 are stopped and all interrupts are disabled except for MSSP and INT0. The program can only progress to step 214 after one of these two interrupts has occurred, waking the processor from sleep, and the interrupt handler routine 100 has been executed. Step 216 is then executed, setting the first shot tracker to indicate that a shot has been detected from sleep mode, and the main program 200 loops back to step 206.

Figure 4:
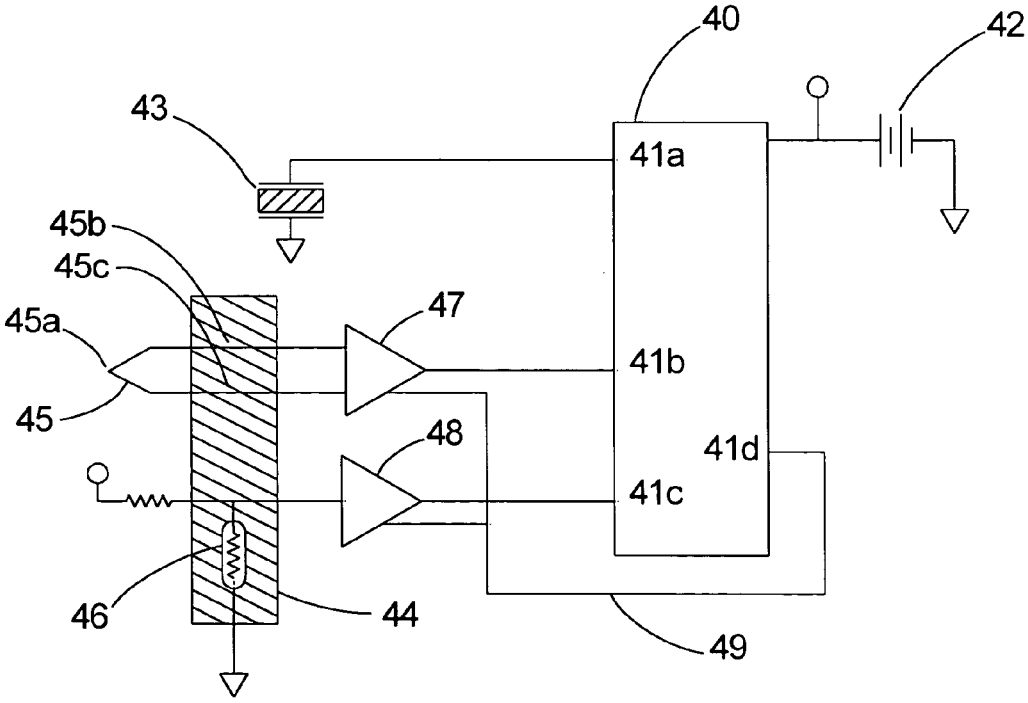
FIG. 4 is a block diagram showing the major electrical components of the invention.
Figure 14:
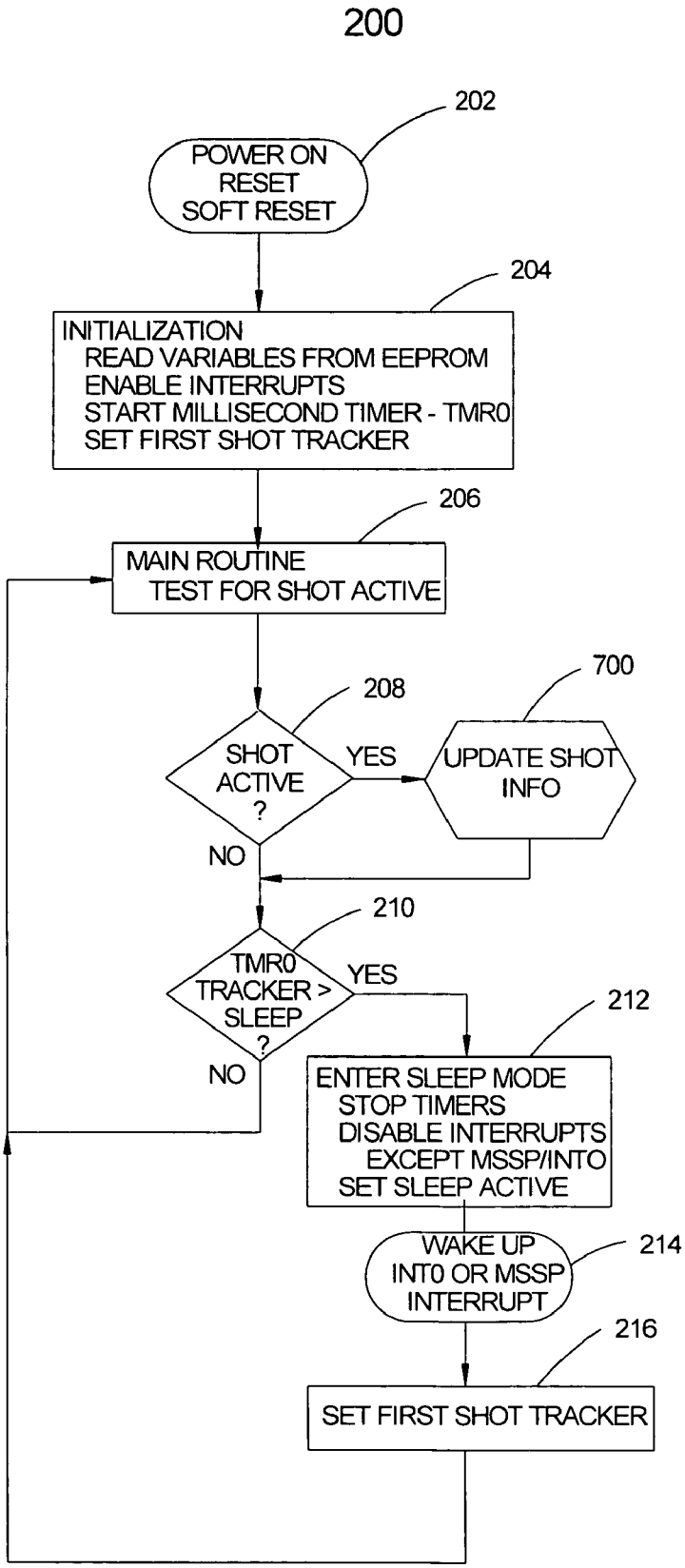
FIG. 14 is a flow-chart for the shot counter's main program.

The operation of the shot counter can be most easily understood by following the events that occur beginning with the processor in its sleep mode at step 212 in FIG. 14. When a shot occurs the acceleration from the recoil produces a voltage at the piezo-electric accelerometer 43 in FIG. 4. If the signal from the accelerometer 43 exceeds the threshold at the comparator 41*a* INT0 is activated and the interrupt handler routine 100 in FIG. 9 is activated. Interrupts are disabled in step 102 and tests on various interrupts are evaluated until INT0 is found to be true in step 108. Program control then passes to the INT0 interrupt service routine 500 in FIG. 12.

The holdoff tracker has not yet been set true so step 504 is executed. Since this is the first shot detected after waking, the value saved for the TMR0 tracker value is irrelevant. The shot active tracker is set true, TMR1 is started (initiating the hold-off period) and TMR0 is reset. It should be noted, however, that TMR0 is not restarted and cannot produce interrupts at this step—timing during the hold-off period is controlled by TMR1.

Control returns to the interrupt handler routine 100 at step 112 and from there to the main program 200 at step 216 as shown in FIG. 14. The first shot tracker is set true at 216 and the program loops to step 208 where the shot active tracker is found to be true. Control then passes to the update shot information subroutine 700 in FIG. 15.

At step 702 the bin tracker is initialized and the TMR0 tracker is read and added to the hold-off period to get the interval between shots. Since the shot counter has just awakened from its sleep mode the interval is indeterminate and when the value of the first shot tracker is tested in step 704 the program braches to step 712. The initial value of the bin tracker, which was assigned in step 702, points to the wake-up bin within the shot interval histogram. The value in this bin is read, incremented and returned to memory.

With the shot interval histogram updated the temperature is next read in step 714. Power is supplied to the op-amps 47 and 48 in FIG. 4 from the remote enable line 41*d* of the microprocessor and the voltages are read from the thermocouple 45 and thermistor 46. The barrel temperature is then calculated using look-up tables and reference junction compensation.

The sequence used to update the temperature histogram varies slightly from that used for the shot interval because all temperatures are determinate. The bin tracker is initialized in step 718 and the upper limit of each bin is tested sequentially until one is found to be greater than the calculated temperature in steps 720, 722 and 724. The subroutine then branches out of this loop to step 726 where the count in the appropriate bin is read, incremented and returned to memory. The shot active tracker is then set false and control returns to the main program 200 at step 210.

The TMR0 tracker has not yet been updated so when tested at step 210 the program loops back to 206 and continues to loop through steps 208 and 210 until an INT0 interrupt occurs. Referring now to FIG. 7 the impulse 72 will occur when the bolt impacts the back-stop, triggering the comparator to generate INT0. The interrupt handler routine 100 in FIG. 9 is activated. Interrupts are disabled in step 102 and tests on various interrupts are evaluated until INT0 is found to be true in step 108. Program control then passes to the INT0 interrupt service routine 500 in FIG. 12.

This time through subroutine 500, the holdoff tracker has been set true so step 504 is not executed. TMR1, which controls the hold-off, continues to increment and the shot active tracker is not turned on. As a result, when control returns to main program 200 it continues to loop through steps 206–210.

A final impulse 73, shown in FIG. 7, may then occur as the bolt returns and locks into position. The interrupt handler routine 100 in FIG. 9 is again activated. Interrupts are disabled in step 102 and tests on various interrupts are evaluated until INT0 is found to be true in step 108. Program control then passes to the INT0 interrupt service routine 500 in FIG. 12.

This time through subroutine 500 the holdoff tracker has been set true so step 504 is not executed. TMR1, which controls the hold-off, continues to increment and the shot active tracker is not turned on. As a result, when control returns to main program 200 in FIG. 14 it continues to loop through steps 206–210.

The next event to occur is the interrupt generated when TMR1 reaches its time-out state. The interrupt handler routine 100 in FIG. 9 is executed. Further interrupts are disabled in step 102 and interrupts are evaluated until TMR1 is found to be true in step 110. Program control then passes to the TMR1 interrupt service routine 600 in FIG. 13. The TMR0 tracker is cleared and TMR0 is restarted in step 602. This timer will be used to determine the interval to the next shot. Control then passes back through subroutine 100 to main program 200 in FIG. 14.

It must be emphasized that the number of impulses that occur during the firing of a shot may vary from the three shown in FIG. 7. The hold-off period makes it possible to accurately count shots whether a single impulse or any number of impulses are produced during firing. This makes it possible to accommodate a wide variety of small-armis simply by adjusting the user-programmable hold-off time.

If no other shot is detected before the TMR0 tracker exceeds the sleep value, which is evaluated each time the main program passes through step 210, then step 212 will be executed. The timers will then be stopped, all interrupts except INT0 or MSSP disabled, and the processor will enter sleep-mode. If, however, a shot is detected before step 212 is executed then INT0 is activated and the program enters the interrupt handler routine 100 shown in FIG. 9. Interrupts are disabled in step 102 and tests on various interrupts are evaluated until INT0 is found to be true in step 108. Program control then passes to the INT0 interrupt service routine 500 shown in FIG. 12.

The holdoff tracker has not yet been set true so step 504 is executed. The value of the TMR0 tracker is saved so that the interval between shots may later be calculated. The shot active tracker is set true, TMR1 is started (initiating the hold-off period) and TMR0 is reset. As noted previously TMR0 is not restarted.

Control returns to the interrupt handler routine 100 at step 112 and from there to the main program 200 within the loop through steps 206–210 as shown in FIG. 14. At step 208 the shot active tracker is found to be true. Control then passes to the update shot information subroutine 700 in FIG. 15.

At step 702 the bin tracker is initialized and the TMR0 tracker is read and added to the hold-off period to get the interval between shots. As this is not the first shot detected since the processor awoke the first shot tracker is found to be false at step 704 and the bin tracker is incremented from its initial value. The upper limit of each bin is tested sequentially until one is found to be greater than the interval between shots in steps 708 and 710. The subroutine then branches out of this loop to step 712 where the count in the appropriate bin is read, incremented and returned to memory. The temperature data is then read and stored in the appropriate bin in steps 714 through 726. The shot active tracker is cleared in step 728 and control returns to the main program 200 at step 210.

The TMR0 tracker has not yet been updated so when tested at step 210 the program loops back to 206 and continues to loop through steps 208 and 210 until an INT0 interrupt occurs. From this point onwards program flow is identical to that already described for the first shot detected from waking.

For the shot counter to be used in a program of small-arms maintenance it must be possible to easily access and interpret the collected data. This has been accomplished by providing histograms that can be displayed on a hand-held computer or down-loaded into another computing device. Subsequent analysis can apply weighting functions to predict wear-out where, for example, shots fired at high barrel temperature are weighted more heavily. Sample histograms for firing rate and temperature are shown in FIGS. 8*a* and 8*b*. Limits for each bin and the number of bins per histogram are user programmable.

In another embodiment of the invention the time and date of firing is stored for subsequent analysis. This is of particular importance in law-enforcement where reconstruction of events may be required. Time can be kept within the microprocessor, however, less power is consumed by using a stand-alone time and date chip. Time and date can be stored as each shot is fired up to the limit of available memory.

While the invention has been described in connection with a particular embodiment, it is not intended to limit the scope of the invention to the particular form set forth, but on the contrary, it is intended to cover such alternatives, modifications, and equivalents as may be included within the spirit and scope of the invention as defined by the appended claims.

Primary Elements:

A device that senses that a shot has been fired from a gun using its acceleration, acoustic noise or RF emissions.

A device that measures the interval between shots so that the firing rate may be determined.

A device that measures the time at which each shot has been fired.

A device that measures the temperature of the barrel when each shot is fired.

A device that stores any combination of temperature, firing rate, firing intervals and time data for subsequent analysis.

An electrical interface to transfer data from the device to a computer or other data collection device.

Secondary Elements:

An enclosure for the device that protects it from the heat produced by the gun.

An enclosure for the device that forms a Faraday cage, preventing RF interference or susceptibility.

A mount for the device that can attach it directly to a gun barrel while thermally insulating it so that the device remains on the barrel when removed from the gun.

An accelerometer to sense the recoil of the gun so that the firing of a shot may be detected.

A thermocouple that is in contact with the barrel so that its temperature may be measured.

Two or more timers within the device's circuitry that may be used for time and date and for determining firing intervals.

Memory within the device for storing data.

An enclosure for the device that can be placed in a depth of 60 feet of water or at an altitude of 50,000 feet without damage.

Substitute Elements:

An acoustic sensor, such as a microphone, to sense that a shot has been fired.

An accelerometer oriented to use transverse or dilational waves in the gun barrel to detect that a shot has been fired.

An antenna that detects firing from the RF field generated when a shot is fired.

A means to detect stress created by barrel expansion when a shot has been fired.

A means to detect gas emissions when a shot has been fired.

A means to detect light emissions when a shot has been fired.

A means to detect bolt movement when a shot has been fired.

An IR device that is used to determine barrel temperature without contact.

A mount for the device that is not attached to the barrel for applications when temperature is not required or when non-contact temperature measurements are made.

What is claimed is:

1. A device for collecting data on usage of a firearm having a barrel, comprising:

a single accelerometer mounted on the firearm producing a signal on a signal output in response to sensing an impulse in the weapon;

a processor having an input coupled to the signal output, such that a signal on the signal output of the accelerometer which exceeds a threshold level is sensed as a shot;

the processor having a hold-off delay after a shot is sensed such that additional signals on the signal output of the accelerometer are not sensed as shots until after the hold-off delay, the hold-off delay being chosen such that all subsequent impulses produced during firing a shot fall within the hold-off delay;

a memory coupled to the processor, for storing information related to shots sensed by the processor.

2. The device of claim 1, in which the information stored in the memory comprises an interval between firing of shots.

3. The device of claim 2, in which the interval between shots is used by the processor to derive a fire rate for the firearm, and the information stored in the memory comprises a maximum fire rate.

4. The device of claim 1, further comprising a temperature sensor coupled to the barrel of the firearm and the processor, in which the information stored in the memory comprises temperature of the barrel as each shot is fired.

5. The device of claim 4, further comprising at least one amplifier having an input coupled to the temperature sensor and an output coupled to the processor.

6. The device of claim 5, in which the processor is programmed to apply power to the amplifier only during a measurement period, such that power consumption is reduced.

7. The device of claim 4, in which the temperature sensor is a thermocouple in contact with the barrel.

8. The device of claim 4, in which the temperature sensor is an infrared detector.

9. The device of claim 1, further comprising an interface coupled to the processor, for transferring data from the device to an external data collection device.

10. The device of claim 9, further comprising an external data collection device comprising a programmed computer coupled to the processor through the interface.

11. The device of claim 1, in which the information stored in the memory is stored as a histogram.

12. The device of claim 1, in which the information stored in the memory comprises date and time that each shot was fired.

13. The device of claim 1, in which the memory is non-volatile memory.

14. The device of claim 1, in which the information stored in the memory comprises identifying data regarding the weapon, selected from the group comprising serial number, barrel number, model number and last date of service.

15. The device of claim 1, in which the hold-off delay is variable.

16. The device of claim 1, further comprising a case housing at least the processor and the memory.

17. The device of claim 16, in which the device further comprises clips for attaching the case to the barrel, and a thermal insulator applied to the case, for providing thermal insulation between the case and the barrel.

18. The device of claim 17, further comprising a temperature sensor embedded within a contact surface of the thermal insulator, such that the sensor is in contact with the barrel of the firearm when the case is mounted to the barrel by the clips, the sensor being coupled to the processor, and the information stored in the memory comprises temperature of the barrel as each shot is fired.

19. The device of claim 16, in which the device further comprises a strap for attaching the case to the barrel and a plurality of segments of thermal insulator for providing thermal insulation between the case and the barrel, the segments being clamped to the barrel by the strap, the case being attached to one of the plurality of segments.

20. The device of claim 19, further comprising a temperature sensor passing through one of the segments of thermal insulator, such that the sensor is in contact with the barrel of the firearm when the case is mounted to the barrel by the strap, the sensor being coupled to the processor, and the information stored in the memory comprises temperature of the barrel as each shot is fired.

21. The device of claim 16, in which the case further comprises a mounting rail for mounting the case to the barrel, and a heat shield for providing thermal insulation between the case and the barrel.

22. An electronic system for collecting data from small-arms, comprising:

at least one device for collecting data on usage of a firearm having a barrel, comprising:

a single accelerometer mounted on the firearm producing a signal on a signal output in response to sensing an impulse in the weapon;

a processor having an input coupled to the signal output, such that a signal on the signal output of the accelerometer which exceeds a threshold level is sensed as a shot;

the processor having a hold-off delay after a shot is sensed such that additional signals on the signal output of the accelerometer are not sensed as shots until after the hold-off delay, the hold-off delay being chosen such that all subsequent impulses produced during firing a shot fall within the hold-off delay;

a memory coupled to the processor, for storing information related to shots sensed by the processor; and an interface coupled to the processor, for transferring data from the device;

an external data collection device comprising a programmed computer coupled to the processor through the interface.

23. A method of collecting data on usage of a firearm having a barrel, comprising the steps of:

mounting a single accelerometer on the firearm, the accelerometer producing a signal on a signal output in response to sensing an impulse in the weapon;

processing the signal in a processor, such that a signal on the signal output of the accelerometer which exceeds a threshold level is sensed as a shot;

after a shot is sensed, starting a hold-off delay, such that additional signals on the signal output of the accelerometer are not sensed as shots until after the hold-off delay, the hold-off delay being chosen such that all subsequent impulses produced during firing a shot fall within the hold-off delay;

storing information related to shots sensed by the processor in a memory.

24. The method of claim 23, in which step of storing information comprises storing an interval between firing of shots.

25. The method of claim 24, further comprising the steps of deriving a fire rate for the firearm from the interval between shots, and in which step of storing information comprises storing a maximum fire rate in the data.

26. The method of claim 24, further comprising the step of sensing barrel temperature after a shot is detected and in which step of storing information comprises storing information on barrel temperature in the memory.

27. The method of claim 23, in which the step of storing information comprises storing date and time that each shot was fired in the memory.

28. The method of claim 23, in which the information stored in the memory is stored as a histogram.

29. The method of claim 23, further comprising the step of storing identifying data in the memory regarding the weapon, selected from the group comprising serial number, barrel number, model number and last date of service.

30. The method of claim 23, further comprising the step of unloading the stored information from the memory to an external data collection device comprising a programmed computer coupled to the processor through an interface.

31. A device for collecting data on usage of a firearm having a barrel, comprising:

an RF detector mounted on the firearm producing a signal on a signal output in response to sensing a radio-frequency impulse;

a processor having an input coupled to the signal output, such that a signal on the signal output of the RF detector which exceeds a threshold level is sensed as a shot;

a memory coupled to the processor, for storing information related to shots sensed by the processor.

32. The device of claim 31, in which the information stored in the memory comprises an interval between firing of shots.

33. The device of claim 32, in which the interval between shots is used by the processor to derive a fire rate for the firearm, and the information stored in the memory comprises a maximum fire rate.

34. The device of claim 31, further comprising a temperature sensor coupled to the barrel of the firearm and the processor, in which the information stored in the memory comprises temperature of the barrel as each shot is fired.

35. The device of claim 34, further comprising at least one amplifier having an input coupled to the temperature sensor and an output coupled to the processor.

36. The device of claim 35, in which the processor is programmed to apply power to the amplifier only during a measurement period, such that power consumption is reduced.

37. The device of claim 34, in which the temperature sensor is a thermocouple in contact with the barrel.

38. The device of claim 34, in which the temperature sensor is an infrared detector.

39. The device of claim 31, further comprising an interface coupled to the processor, for transferring data from the device to an external data collection device.

40. The device of claim 39, further comprising an external data collection device comprising a programmed computer coupled to the processor through the interface.

41. The device of claim 31, in which the information stored in the memory is stored as a histogram.

42. The device of claim 31, in which the information stored in the memory comprises date and time that each shot was fired.

43. The device of claim 31, in which the memory is non-volatile memory.

44. The device of claim 31, in which the information stored in the memory comprises identifying data regarding the weapon, selected from the group comprising serial number, barrel number, model number and last date of service.

45. The device of claim 31, in which the hold-off delay is variable.

46. The device of claim 31, further comprising a case housing at least the processor and the memory.

47. The device of claim 46, in which the device further comprises clips for attaching the case to the barrel, and a thermal insulator applied to the case, for providing thermal insulation between the case and the barrel.

48. The device of claim 47, further comprising a temperature sensor embedded within a contact surface of the thermal insulator, such that the sensor is in contact with the barrel of the firearm when the case is mounted to the barrel by the clips, the sensor being coupled to the processor, and the information stored in the memory comprises temperature of the barrel as each shot is fired.

49. The device of claim 46, in which the device further comprises a strap for attaching the case to the barrel and a plurality of segments of thermal insulator for providing thermal insulation between the case and the barrel, the segments being clamped to the barrel by the strap, the case being attached to one of the plurality of segments.

50. The device of claim 49, further comprising a temperature sensor passing through one of the segments of thermal insulator, such that the sensor is in contact with the barrel of the firearm when the case is mounted to the barrel by the strap, the sensor being coupled to the processor, and the information stored in the memory comprises temperature of the barrel as each shot is fired.

51. The device of claim 46, in which the case further comprises a mounting rail for mounting the case to the barrel, and a heat shield for providing thermal insulation between the case and the barrel.

* * * * *